US006247905B1

(12) United States Patent
Dohner

(10) Patent No.: US 6,247,905 B1
(45) Date of Patent: Jun. 19, 2001

(54) METHOD AND APPARATUS FOR ACTIVELY CONTROLLING A MICRO-SCALE FLEXURAL PLATE WAVE DEVICE

(75) Inventor: Jeffrey L. Dohner, Albuquerque, NM (US)

(73) Assignee: Sandia Corporation, Albuquerque, NM (US)

( * ) Notice: Subject to any disclaimer, the term of this patent is extended or adjusted under 35 U.S.C. 154(b) by 0 days.

(21) Appl. No.: 09/213,202

(22) Filed: Dec. 17, 1998

(51) Int. Cl.[7] ..... F04B 17/00

(52) U.S. Cl. ..... 417/322; 417/436; 417/412; 417/413.1

(58) Field of Search ..... 417/436, 412, 417/413.1, 322

(56) References Cited

U.S. PATENT DOCUMENTS

| | | | | |
|---|---|---|---|---|
| 2,195,792 | * | 4/1940 | Straatveit | 103/53 |
| 2,971,471 | * | 2/1961 | Huebschman | 103/152 |
| 3,029,743 | * | 4/1962 | Johns | 103/150 |
| 3,264,998 | * | 8/1966 | Dingman | 103/1 |
| 4,697,989 | * | 10/1987 | Perlov et al. | 417/53 |
| 5,006,749 | | 4/1991 | White | 310/323 |
| 5,096,388 | * | 3/1992 | Weinberg | 417/322 |
| 5,270,484 | * | 12/1993 | Tsuchiya | 118/653 |
| 5,661,233 | | 8/1997 | Spates et al. | 73/61.45 |
| 5,705,018 | | 1/1998 | Hartley | 156/345 |
| 5,706,840 | | 1/1998 | Schneider et al. | 134/56 R |
| 5,836,203 | | 11/1998 | Martin et al. | 73/579 |
| 5,836,750 | * | 11/1998 | Cabuz | 417/322 |

OTHER PUBLICATIONS

Martin et al. "Magnetically–Excited Flexural Plate Wave Resonator" IEEE International Frequency Control Symposium, pp. 25–31, May 28–30, 1997.*

Butler et al. "Magnetically–Excited Flexural Plate Wave Device" Transducer '97, International Conferance on Solid State Sensors and Actuators, Jun. 16–19, 1997.*

Erick Stemme and Goran Stemme, Electronics Cooling Technical Brief, "*A Valveless Flouid Pump for Electronics Cooling*," http://www.electronics–cooling.com/Resources/EC–Articles/JAN96/jan96tb2.htm.

Anders Olsson, et al., *Valve–less Fluid Micro–pump*,' http://www.s3.kth.se/instralab/MEMS/Research/pump.html.

Anders Olsson, Annual Report 95–96: Signals, Sensors and Systems, KTH, "*Valve–less Diffuser Pumps for Liquids: Abstract*," http:/www.s3.kth.se/annual/S3–9596/instlab.htm.

Wenzel and White, "*A Multisensor Employing an Ultrasonic Lamb–Wave Osillator*," IEEE Transactions on Electronic Devices, vol. 35, No. 6, pp. 736–743, Jun. 1998.

(List continued on next page.)

*Primary Examiner*—Charles G. Freay
*Assistant Examiner*—Timothy P. Solak
(74) *Attorney, Agent, or Firm*—Suzanne L. K. Rountree; George H. Libman; V. Gerald Grafe

(57) ABSTRACT

An actively controlled flexural plate wave device provides a micro-scale pump. A method of actively controlling a flexural plate wave device produces traveling waves in the device by coordinating the interaction of a magnetic field with actively controlled currents. An actively-controlled flexural plate wave device can be placed in a fluid channel and adapted for use as a micro-scale fluid pump to cool or drive micro-scale systems, for example, micro-chips, micro-electrical-mechanical devices, micro-fluid circuits, or micro-scale chemical analysis devices.

19 Claims, 10 Drawing Sheets

Section A-A

OTHER PUBLICATIONS

Martin, et al., "*Magnetically–Excited Flexural Plate Wave Resonator*,".Proceedings of the IEEE International Frequency Control Symposium, pp. 25–31, May 28–30, 1997, referred to as *Martin'97*.

Butler, et al., "*Magnetically–Excited Flexural Plate Wave Device*," Transducers '97, International Conference on Solid–State Sensors and Actuators, Jun. 16–19, 1997.

Moroney, et al., "*Fluid Motion Produced by Ultrasonic Lamb Waves*," IEEE Ultrasonics Symposium, Dec. 4–7, 1990.

Martin, et al., "*Flexural Plate Wave Resonator Excited with Lorentz Forces*," Journal of Applied Physics, vol. 83, No. 9, pp. 4589–4601, May 1, 1998, referred to as *Martin'98*.

Dohner, "*Aspects of the Micro–Scale Acoustics of a Fluid Loaded Flexural Plate Wave Sensor*," Sandia Report SAND97–2772 UC–705, printed Nov. 1997, available outside Sandia Dec. 22, 1997.

* cited by examiner

λ
λ
P
FPWD time = t1
point P on traveling wave
P
FPWD time = t2
P
FPWD time = t3

METHOD AND APPARATUS FOR ACTIVELY CONTROLLING A MICRO-SCALE FLEXURAL PLATE WAVE DEVICE

This invention was made with Government support under Contract DE-AC04-94AL85000 awarded by the U.S. Department of Energy. The Government has certain rights in the invention.

BACKGROUND OF THE INVENTION

This invention relates to the field of micro-scale flexural plate wave devices and more particularly to the active control of a flexural plate wave device to continuously propagate traveling waves therein, and to pump fluids by mounting the device with a fluid channel. The term active control denotes forcing and controlling a desired response in an excited device.

Micro-scale devices (e.g., with part dimensions around 2000 μm in length or smaller, and less than 1 or 2 μm in thickness) such as micro-chips, micro-electro-mechanical devices, and micro-fluid circuits often require micro-scale fluid pumps to cool or drive them. Micro-pumps can be used to drive micro-cooling systems for elimination of detrimental heat in circuitry, to manipulate micro-scale objects, and to power micro-fluid systems as an alternative to micro-electronics.

Wave Motion

The excitation of bounded objects such as plates and membranes can produce resultant wave motion within the excited object. Whenever excitation matches the inherent natural frequency of an object: a standing wave develops, the object is said to be in resonance, and the object exhibits an enhanced response.

When an object is unbounded, or wave motion is removed from a boundary, waves propagate. Particles within the object oscillate in the same manner but with different phase to produce directional traveling waves. At boundaries, wave motion in an object may be reflected. A standing wave is composed of traveling waves reverberating between boundaries.

Existing Fluid Pumps And Micromotors

Mechanical pumps are used successfully at the larger macro-scale level in conventional applications to raise, transfer, or compress fluids. Conventional macro- scale mechanical pumps consist of diaphragms, valves, vibrating membranes, and other moving parts that require clearances between those moving parts. At the macro-scale, the required clearances are only a fraction of the size of the manufactured part. As the pump size is driven down to the micro-scale and even smaller, the clearances become much larger in comparison to the manufactured part. While manufacturing tolerances are extremely small, the tolerances are fixed by the fabrication methods and are not likely to be reduced indefinitely for increasingly smaller manufactured parts. Mechanical pumps, therefore, can be difficult to scale down to micro-scale, and problems can occur with clearances between moving parts; thus, mechanical pumps are not generally used as micro-pumps.

Peristaltic pumps have been proposed as an alternative to mechanical pumps. Peristaltic pumping is a form of fluid transport that occurs when progressive contraction or expansion propagates along the length of a distensible tube containing a liquid. Hartley, U.S. Pat. No. 5,705,018 (1998), describes a peristaltic pump in a channel, where sequential application of voltage generates electrostatic fields which sequentially excite a series of conductive strips lining the channel, which in turn successively pull an overlying flexible conductive membrane into the channel to achieve peristaltic pumping action. Electrostatic peristaltic pumping works for sequential excitation of the strips lining a membrane-enclosed channel, and thus progressive contraction and expansion (pulsating) of the channel. Electrostatic peristaltic pumps, however, can be difficult to fabricate and require a membrane-enclosed channel and an additional timing mechanism (oscillator clocking frequency) to provide a progressive rate of strip excitation. Further, Hartley's peristaltic pump only functioned with electrically nonconductive fluids. Magnetic embodiments for electrically conductive fluids would be more complex, require significantly greater amounts of power, and function over a more restrictive temperature range. See Hartley.

Piezoelectric pumps have been proposed as an alternative to mechanical pumps. Valveless fluid pumps can use millimeter-scale diffuser/nozzles with oscillating pump diaphragms, driven by piezoelectric discs. See Erik Stemme and Goran Stemme, Electronics Cooling Technical Brief: "A Valveless Fluid Pump for Electronics Cooling," January 1996, retrieved from the Internet. Diffusers are gradually expanding flow channels with flow resistance differences at the nozzle and diffuser ends, and are used to raise static pressure. Movement in a silicon and glass pump chamber, excited by piezoelectric discs, forces fluid through the diffuser/nozzles. See Anders Olsson et al., "Valve-less Fluid Micro-pump," KTH, Instrumentation Laboratory, S3, August 1997, retrieved from the Internet; Anders Olsson, Annual Report 95-96: Signals, Sensors and Systems, KTH, "Valve-less Diffuser Pumps for Liquids: Abstract," retrieved from the Internet. The piezoelectric pump works for pumping fluid using finite-sized fluid chambers and an oscillating diaphragm (pulsating fluid), and piezoelectric materials work for exciting and detecting acoustic waves. Piezoelectric materials' processing and fabrication, however, can be difficult due to piezoelectric materials incompatibility with a silicon processing line.

Micromotors have been used to move micro-objects on a membrane in a gaseous or vacuum environment. White, U.S. Pat. No. 5,006,749 (1991), describes a micromotor device for linear movement of one or more microelements on a membrane, with control maintained using a linear position sensor including a circuit for producing feedback control signals. The micromotor device works for moving miniature mechanical parts using ultrasonic waves and feedback control signals, but has not been applied to fluid motion.

Flexural Plate Wave Devices

Flexural plate wave devices represent a relatively new technology that shows promise for micro-scale application. Conventional flexural plate wave devices typically use interdigital transducers patterned on piezoelectric material to excite and detect acoustic waves in a composite, thin membrane. See Wenzel and White, "A Multisensor Employing an Ultrasonic Lamb-Wave Oscillator," IEEE Transactions on Electron Devices, Vol. 35, No. 6, pp. 735–743, June 1988. Wenzel and White describe a sensitive, composite silicon/piezoelectric device to excite and detect oscillating waves in a thin membrane on a Lamb-wave oscillator sensor. Wenzel and White consider propagation of a lowest order antisymmetric mode, whose wave velocity decreases to zero as the plate is made vanishingly thin. The confinement of acoustic energy in the thin membrane can make excited wave velocities that are extremely sensitive to surface perturbations such as mass accumulation or membrane tension, giving a sensitivity characteristic of flexural plate wave devices that can be useful in sensing applications. Wenzel and White's composite silicon/piezoelectric Lamb-wave device excites oscillating waves in a device for use as a sensor. A composite Lamb-wave device can be difficult to fabricate, however, and there is no teaching of using the device for anything other than an oscillator sensor.

In a magnetically-excited flexural plate wave device used as a resonator, the piezoelectric layer in the conventional composite membrane is eliminated to simplify device fabrication and integration with control electronics. See Martin et al., "Magnetically-Excited Flexural Plate Wave Resonator," Proceedings of the IEEE International Frequency Control Symposium, pp. 25–31, May 28–30, 1997, hereafter referred to as Martin'97. Magnetically-excited flexural plate wave devices can be manufactured using lithographic methods and bulk micromachining to construct a free-standing membrane on a silicon substrate. See Butler et al., "Magnetically-Excited Flexural Plate Wave Device," Transducers '97, International Conference on Solid-State Sensors and Actuators, Jun. 16–19, 1997. A flexural plate wave resonator can be used to produce resonant standing waves in a membrane, where the generated waves resonate between membrane-plate boundaries. Martin'97 presents two resonator models: a model that characterizes the impedance for a one-port device and a model that characterizes the transmission response for a two-port device. Waves are reflected by the edges to get a 2D resonant standing wave, or eigenmode, of a rectangular membrane. As an example, a flexural plate wave resonator device is disclosed as suitable for sensing environmental changes that affect membrane tension, such as temperature, differential pressure, and strain. Since the membrane is sensitive to surface mass accumulation, Martin'97 suggests that the addition of a chemically-sensitive film to a flexural plate wave device can enable sensitive chemical detection. The flexural plate wave resonator excites resonant standing waves in a device for use as a sensor, but there is no teaching of using it for propagating traveling waves for a fluid pump.

Schneider et al., U.S. Pat. No. 5,706,840 (1998), describes the use of flexural plate wave sensors in a precision cleaning apparatus. Spates et al., U.S. Pat. No. 5,661,233 (1997), describes an acoustic-wave sensor apparatus for analyzing a petroleum-based composition.

Moroney discloses a rotary motion pump with a flexural plate wave device. See Moroney et al., "Fluid Motion Produced by Ultrasonic Lamb Waves," IEEE Ultrasonics Symposium, Dec. 4–7, 1990. Moroney generated waves with pulsed excitation, and consequently small streaming motion. Moroney used flexural plate waves in microfabricated thin membranes, with a piezoelectric layer, to pump fluids in a rotary motion and to transport solids. Moroney generated a rotary motion on a Lamb-wave membrane device, where acoustic waves produced eliptical fluid circulation in an etched well, within a silicon layer, during a pulsed excitation. Moroney achieved rotary pumping with small streaming motion from pulsed excitations, but Moroney's device was not suitable for pumping fluid for continuous linear fluid flow through a channel.

Accordingly, there is an unmet need for a fluid pump at the micro-scale, that can produce continuous linear fluid flow through a channel, and can be made with simplified fabrication methods compatible with conventional silicon micro-machining technology.

SUMMARY OF THE INVENTION

This invention teaches a new method, termed micro-scale active control, to force and to control a desired wave propagation response in an excited flexural plate wave device. The present invention provides a micro-scale fluid pump that ca n produce continuous linear fluid flow, and can be made with simplified fabrication methods compatible with conventional silicon micro-machining technology.

The present invention comprises a method and apparatus for actively controlling a micro-scale flexural plate wave device to propagate waves in the plate. Active control of a flexural plate wave device can be used to generate non-reflecting, traveling waves in the plate. The traveling waves can be coupled to a viscous fluid to generate continuous linear flow of the fluid.

When an actively-controlled flexural plate wave device according to the present invention is mounted with a fluid channel and traveling waves in the plate are coupled to a fluid, the device can produce a net flow of fluid resulting in a directional micro-scale fluid pump. The present invention can be adapted for use in micro-scale fluid pumps to cool or drive micro-scale systems, for example, micro-chips, micro-electrical-mechanical devices, micro-fluid circuits, or micro-scale chemical analysis devices.

BRIEF DESCRIPTION OF THE FIGURES

The accompanying drawings, which are incorporated into and form part of the specification, illustrate embodiments of the invention and, together with the description, serve to explain the principles of the invention.

DETAILED DESCRIPTION OF THE INVENTION

The present invention provides a micro-scale fluid pump that can be made with fabrication methods compatible with semiconductor processing. The present invention comprises a method and apparatus for actively controlling micro-scale flexural plate wave devices for propagating traveling, non-reflecting waves.

Figure 1:
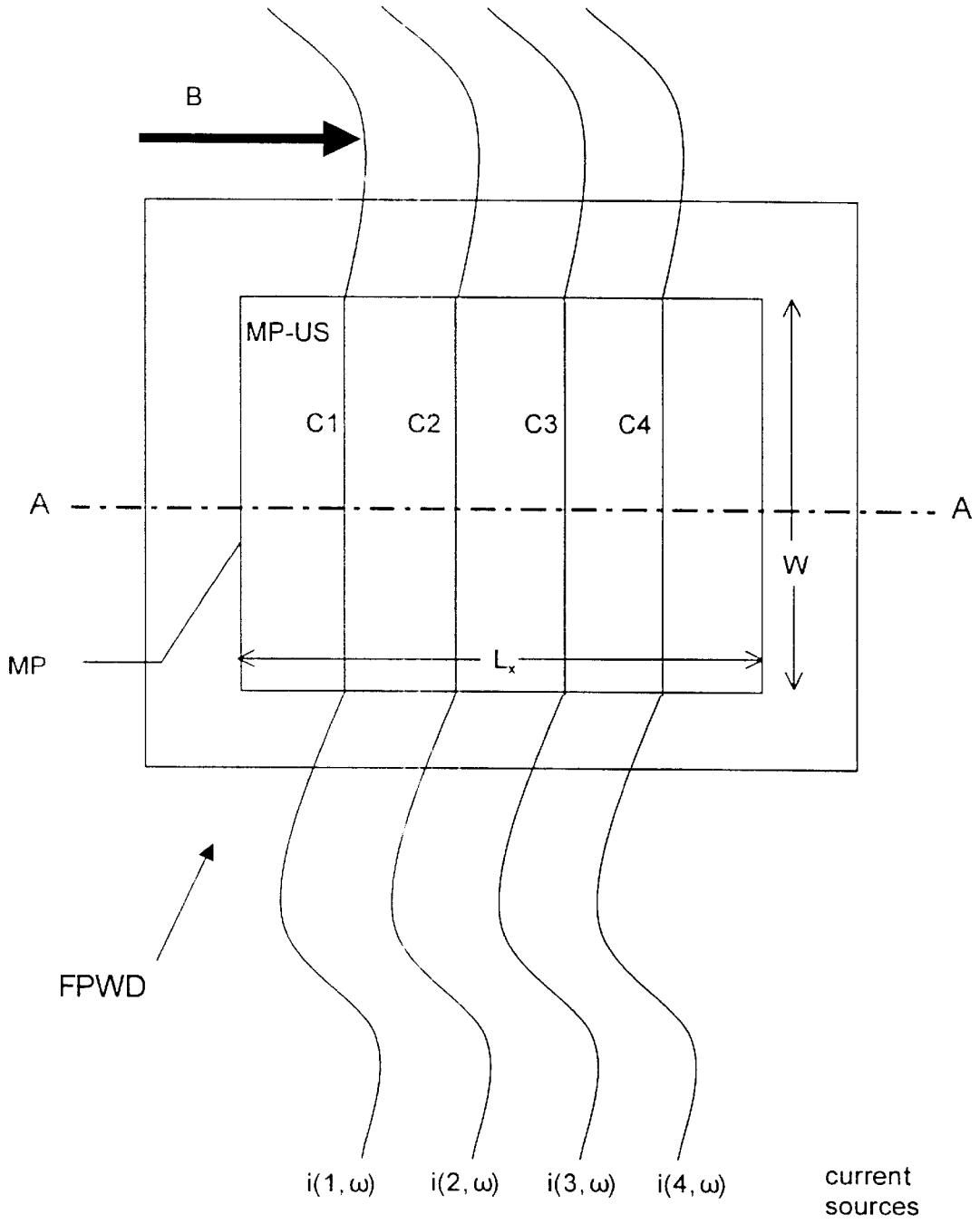
FIG. 1 is a schematic of an actively controlled, micro-scale flexural plate wave device according to the present invention.
Figure 2:
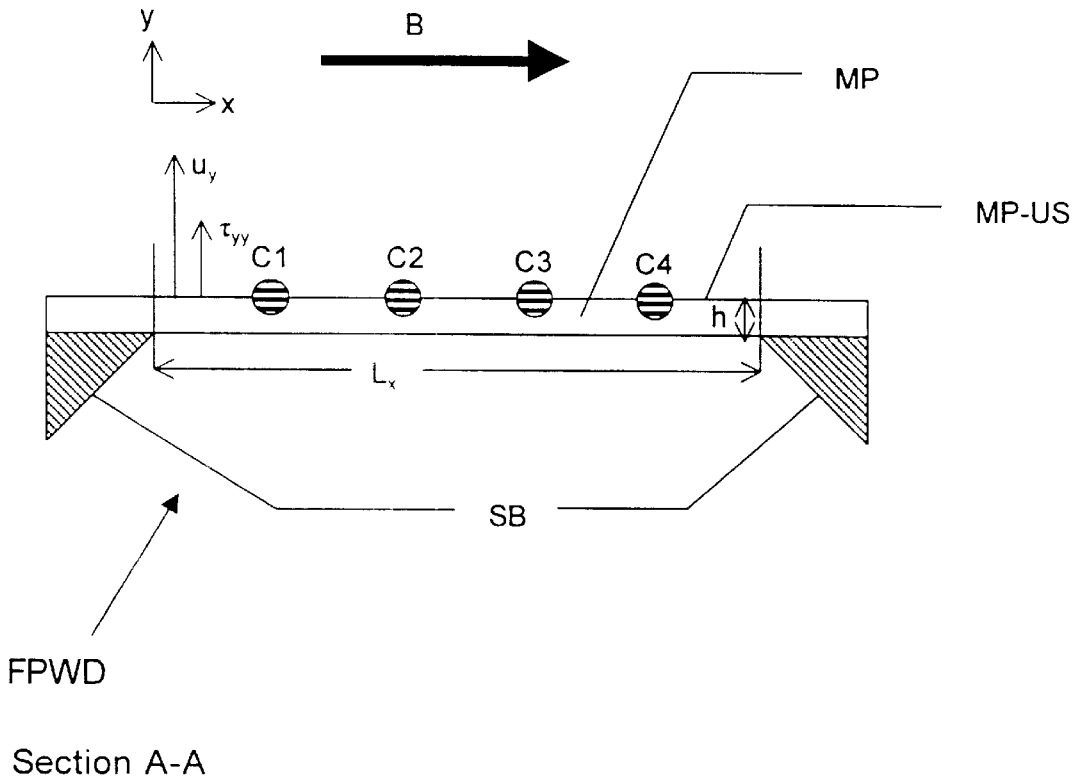
FIG. 2 is a sectional view of an actively controlled, micro-scale flexural plate wave device according to the present invention.

FIGS. 1 and 2 depict an embodiment of a magnetically-excited flexural plate wave device FPWD made of a membrane-plate MP with length $L_x$ in the x-direction and width W, a membrane-plate upper surface MP-US, and a supporting base SB. Four current wires C1, C2, C3, C4 are integrally mounted on or embedded in membrane-plate MP. Each wire C1, C2, C3, C4, spaced along length Lx of membrane-plate MP and extending width W of membrane-plate MP, carries a current i(1,ω), i(2,ω), i(3, ω), i(4,ω), respectively, with a coordinated current amplitude and current phase. Multiple current sources, or a single current source with multiple outputs, can supply currents i(1,ω), i(2,ω), i(3,ω), i(4,ω). A magnetic field of strength B is applied perpendicular to the direction of current flow.

FIG. 2 is a sectional view along dashed line A—A of micro-scale flexural plate wave device FPWD shown schematically in FIG. 1. Flexural plate wave device FPWD has density $\rho_p$. Young's modulus E, membrane-plate MP with thickness h and length $L_x$, Poisson's ratio ν, internal plate tension $T_0$, and flexural plate rigidity D. A normal displacement of the plate is defined $u_y$. Membrane-plate MP includes upper surface MP-US, and mounts with supporting base SB. One or more current sources generate current, with a current amplitude and a current phase, on each of current wires C1, C2, C3, C4, mounted with membrane-plate MP, disposed along the x-direction. The interaction of magnetic field B with current flow i(1,ω), i(2,ω), i(3,ω), i(4,ω), produces a Lorentz force perpendicular to the plate (shown in FIG. 2 as $\tau_{yy}$, the surface-normal stress loading on the plate in the y-direction). If currents i(1,ω), i(2,ω), i(3,ω), i(4,ω), and magnetic field B are properly coordinated, then the Lorentz force produces a traveling wave in membrane-plate MP. The traveling waves move in membrane-plate MP in a direction perpendicular to current flow i(1,ω), i(2,ω), i(3,ω), i(4,ω).

An example flexural plate wave device FPWD consists of a thin silicon nitride (SiN) or polysilicon membrane-plate MP, of non-piezoelectric materials, having a pattern of current wires on the membrane-plate surface. Fabrication can be simplified with the use of non-piezoelectric materials, and elimination of materials' incompatibility in a silicon processing line. Micro-machining methods can be used to construct a free-standing membrane-plate affixed at its boundary to an etched, silicon supporting base SB. Membrane-plate MP is therefore a thin membrane mounted with a thick silicon substrate producing a clamped plate. Waves excited in flexural plate wave device FPWD accordingly can have both membrane and plate components. An example device consists of a SiN membrane-plate supported by a silicon base, which produces a clamped boundary condition at its edges where the membrane-plate and base come together. A Lorentz force resulting from the interaction of a current i with a supplied magnetic field B produces excitation of the membrane-plate. Details on the fabrication of one magnetically-excited flexural plate wave device can be found in Martin et al., "Flexural Plate Wave Resonator Excited with Lorentz Forces," Journal of Applied Physics, Vol. 83, No. 9, pp. 4589–4601, 1 May 1998, hereafter referred to as Martin'98, incorporated herein by reference. Martin'98 describes a magnetically-excited flexural plate wave resonator with a meander-line transducer that produces resonant standing waves. Those skilled in the art will appreciate how to make a Lorentz-activated, magnetically-excited flexural plate wave device, for example, as described by Martin et al., U.S. Pat. No. 5,836,203 (1998), incorporated herein by reference. In Martin's preferred embodiment, a meandering conductor comprises a plurality of parallel legs, with a second meandering conductor also deposited upon a non-piezoelectric membrane. Martin produces resonant standing waves with excitation in single-port or two-port resonant modes. Martin discloses a non-resonant device made by fabricating a parallelogram (rather than rectangular) shaped membrane to suppress membrane eigenmodes. For practice with the current invention, Martin's meandering current lines can be replaced by separate, parallel current wires, mounted with a magnetically-excited flexural plate wave device that is controllably-forced under the present method of active control to produce traveling waves in a rectangular-shaped device. Martin, however, teaches generation of resonant standing waves in a rectangular-shaped device, and generation of non-resonant waves in a parallelogram-shaped device.

Figures 3A, 3B, 3C:
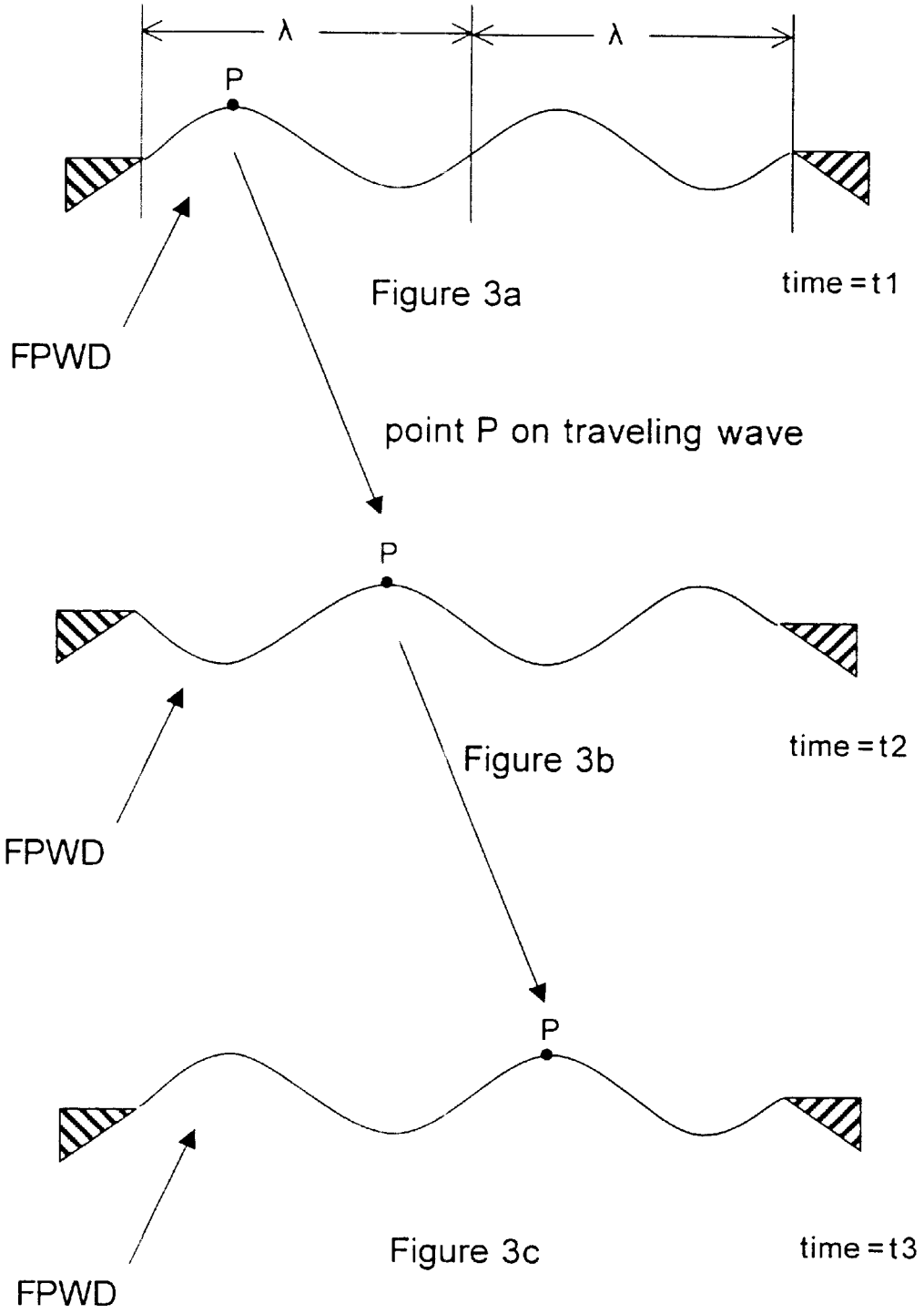
FIGS. 3(*a,b,c*) is a series of time-sequenced, sectional views showing the movement of traveling waves in a flexural plate wave device according to the present invention.

FIG. 3*a* is the first in a series of time-sequenced, sectional views showing the movement of traveling waves in flexural plate wave device FPWD of the present invention. For convenience of illustration, the sectional views in FIGS. 3(*a,b,c*) do not show the current wires or magnetic field details of FIG. 2, and the membrane-plate and traveling wave details have been simplified and exaggerated for clarity. As an example, flexural plate wave device FPWD can be controlled to force membrane-plate MP to respond with a response wavelength corresponding to excitation of a given current wire, extending along membrane-plate width W, where one-half the response wavelength corresponds to width W.

FIGS. 3(*a,b,c*) shows a time-sequence of traveling waves, each having two maximum points and two minimum points. Movement of any peak displacement P on flexural plate wave device FPWD is controllably-forced by phasing inputs on each of the current wires to generate traveling waves. Current in wires C1, C2, C3, C4, interacts with magnetic field B to generate a Lorentz force. For this discussion, positive force results in a wire being attracted upward, while negative force causes a wire to be forced downward.

FIG. 3*a* shows an output traveling wave in the membrane-plate at initial time=t1. The wave shown is in flexural plate wave device FPWD with an amplitude P that corresponds to a membrane-plate displacement in a surface-normal direction. FIG. 3*b* shows an output traveling wave in the membrane-plate at time t2=t1+Δt, where Δt is a time increment. FIG. 3*c* shows an output traveling wave in the membrane-plate at time t3=t1+2Δt. Observe peak amplitude P of wavelength λ as it travels through the membrane-plate in the time-sequenced series, from the initial phase location in FIG. 3*a*, to initial phase +½ phase in FIG. 3*b*, to initial phase location +1 phase in FIG. 3*c*. The motion of peak amplitude P corresponds to a traveling wave. In the example, flexural plate wave device FPWD shown in FIGS. 3(*a,b,c*) has two wavelengths A extending across the membrane-plate.

Active Control Flow Diagram

When a flexural plate wave device is arbitrarily excited through the interaction of current i with magnetic field of strength B. it typically responds with resonant standing waves. By coordinating currents i with magnetic field B, the flexural plate wave device can be actively controlled, according to the present invention, to force the membrane-plate to produce traveling waves.

Control of the flexural plate wave device is termed active because energy can be input into the system in order to overcome a typical structural response of the device and to force a desired response. The practitioner a priori chooses a device in which to generate waves (for example, a flexural plate wave device), identifies the materials (for example, SiN and Si) and properties of the chosen device (such as, D, E, ν, $T_0$, h, and $\rho_p$), and chooses the desired output response (traveling waves with wavelength λ and wave number k) to overcome the structural response of the device (standing waves). The practitioner then forces the traveling wave response (by equating the desired response to a traveling wave to identify current i needed) under the method of micro-scale active control, by inputting a sufficient amount of energy into the system (i and B) and by taking energy out of the system (the natural membrane-plate response), in order to produce traveling wave outputs.

When the flexural plate wave device FPWD of FIGS. 1–3 is excited with the interaction of the current wires with the magnetic field, the plate is forced in a surface- normal y-direction, represented as $\tau_{yy}(x,\omega)$. Active control according to the present invention can force the plate's response in order to produce non-reflecting, traveling waves at locations removed from the boundary. At the boundary, where the free-standing membrane-plate and the supporting base come together, traveling waves cannot be produced.

Figure 4:
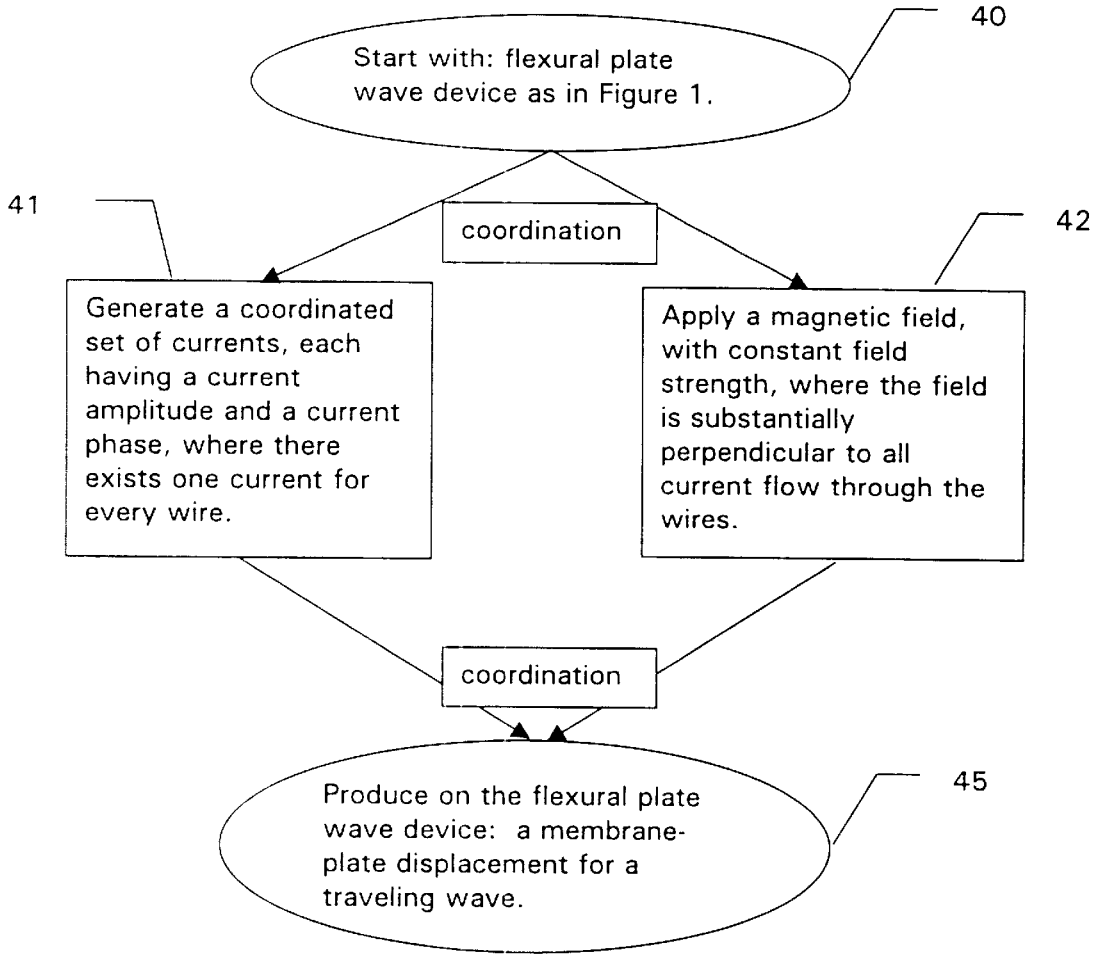
FIG. 4 is a flow diagram of the active control of a micro-scale flexural plate wave device according to the present invention.

FIG. 4 is a flow diagram of the active control method of a micro-scale flexural plate wave device according to the present invention. Start with a flexural plate wave device 40 with a group of membrane-plate surface wires mounted with the upper surface of the device. Generate a coordinated set of currents 41, each with a current amplitude and a current phase, where there is one current for each wire. Apply a magnetic field 42, where the field is substantially perpendicular to all current flow through the wires. The force due to the interaction of all current flow with magnetic field B is coordinated to produce a traveling wave 45. One example of a magnetic field generator is a permanent magnet with a constant strength. Other examples of magnetic field generators can include electromagnets or other known devices able to produce a magnetic field.

In an example flexural plate wave device having a SiN membrane-plate with thickness of 1 $\mu$m, length of 2000 $\mu$m, width approximately ½ the length, and 28 current wires, a practitioner can obtain the current i into each wire required to produce an approximation of a surface-normal stress on the membrane-plate for a traveling wave. For example, from equation 11 given in the following discussion, for $$\frac{iB}{\rho_p h} \approx 1.5\cdot 10^{11}\frac{\mu\text{m}}{s^2},\ \text{where } \rho_p = 1.18\cdot 10^{-17}\frac{kg\cdot m}{\mu\text{m}^3} \text{ and } h = 1\,\mu\text{m},$$

the resulting interaction of current $i$ with magnetic field of strength $$B \text{ is}: |i|\cdot|B| = 1.77\cdot 10^{-6} kg\cdot\frac{m}{s^2\mu\text{m}} \approx 2\cdot 10^{-6}\frac{N}{\mu\text{m}}.$$

The value of iB given in the example above, represents a range of values for both current i and magnetic field strength B, to achieve a desired output response in a flexural plate wave device having identified properties. The interaction of all current flow with the applied magnetic field produces a membrane-plate displacement for a traveling wave in the flexural plate wave device.

EXAMPLE METHOD OF CONTROLLING CURRENTS

Figure 5:
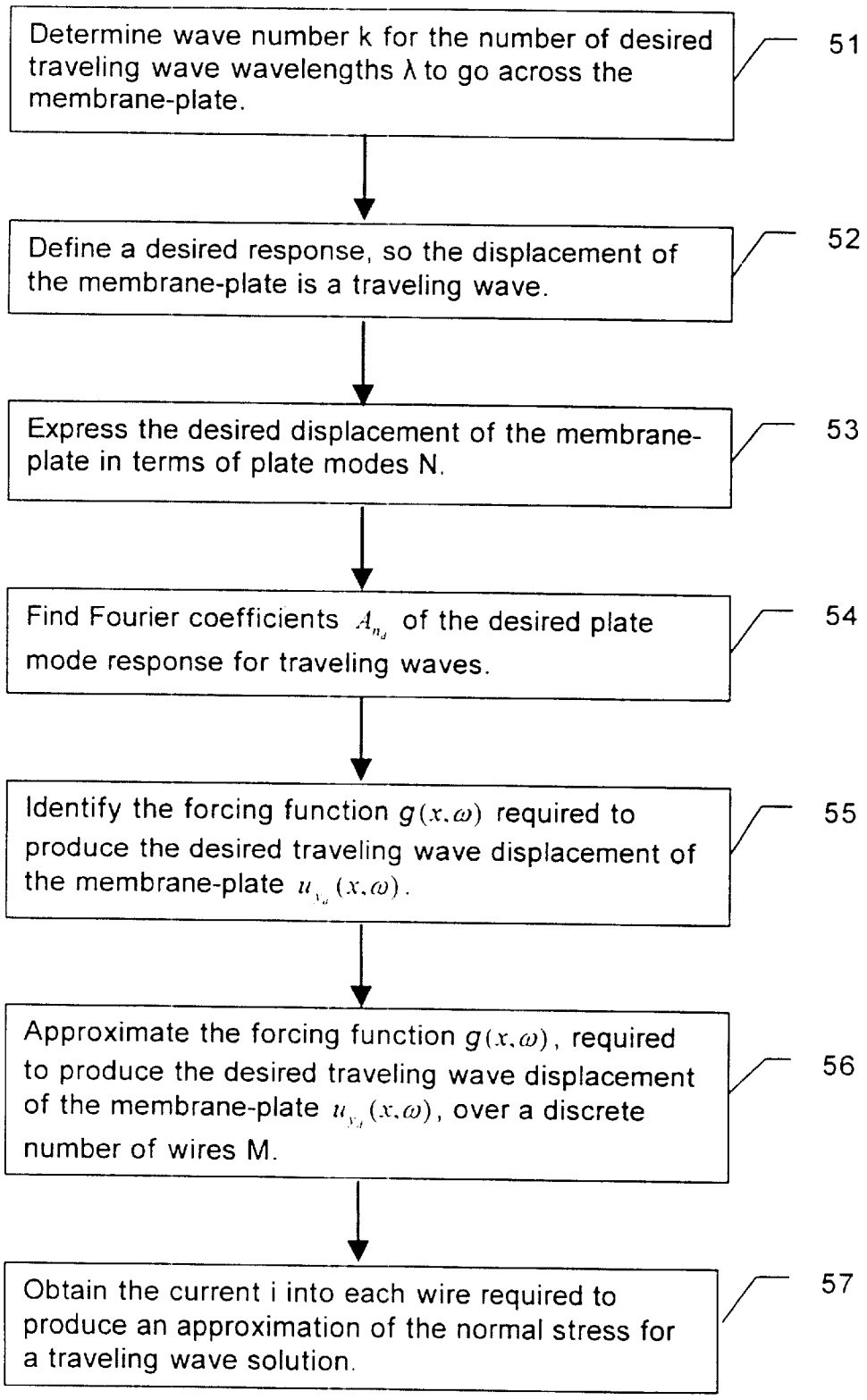
FIG. 5 is a flow diagram of a method according to the present invention of coordinating currents in a flexural plate wave device.

FIG. 5 shows an example of a method of coordinating currents as in the active control method of FIG. 4. The details in the FIG. 5 example are for a light fluid. Those skilled in the art will appreciate modifications to the details of FIG. 4 to accommodate other fluids such as gases, water, and heavy liquids.

The description below sets forth one analytical determination of currents to yield the desired active control. Those skilled in the art will appreciate other determinations, both analytical and experimental, suitable for use with the present invention.

Figure 6:
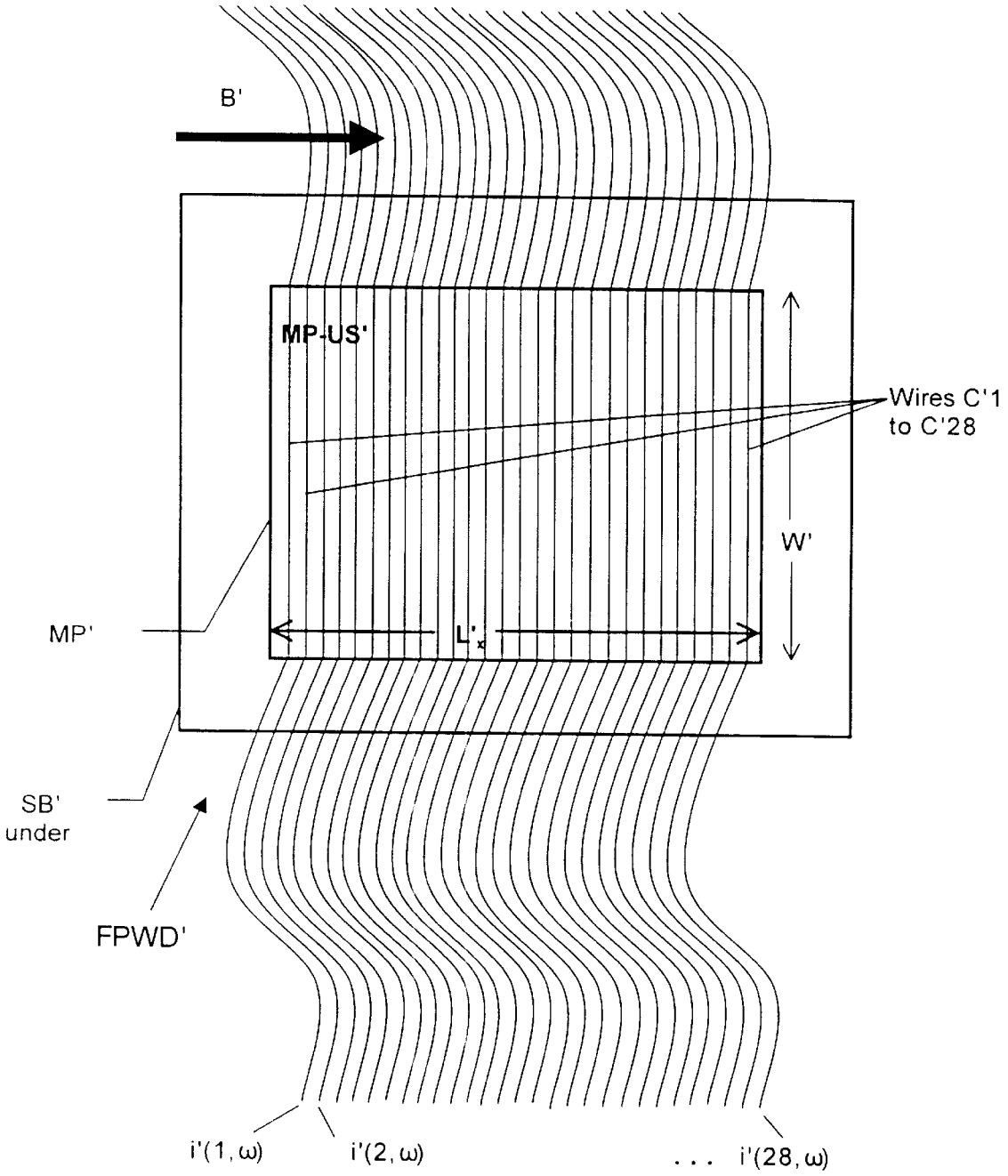
FIG. 6 is a schematic of an actively controlled, micro-scale flexural plate wave device according to the present invention.

FIG. 6 is a schematic of an actively controlled, micro-scale flexural plate wave device according to the present invention. The example method of controlling currents in FIG. 5 is discussed in light of the example flexural plate wave device depicted in FIG. 6.

As an example, start with a flexural plate of thickness h=1 $\mu$m, plate length $L_x$ of 2000 $\mu$m along the x direction. It is preferred that the ratio of membrane-plate length to width be approximately two to one, giving a width of approximately 1000 $\mu$m in the example plate. The membrane-plate can have a free-standing SiN layer over a Si base with conductive current wires, such as gold, on the upper surface.

Select an output traveling wave wavelength $\lambda$ to generate in the membrane-plate, and determine wave number k for the number of wavelengths $\lambda$ that can extend across length Lx of the membrane-plate, step 51. For example, when a sine wave is used, $$k = \frac{2\pi}{\lambda}.$$

Traveling waves can be generated when there are a sufficient number of membrane-plate surface wires for every wave counted in the wave number. As an example, 8 wires for every wave in the wave number can be used to produce traveling waves.

For example, the FIG. 6 flexural plate wave device FPWD' can have two wavelengths $\lambda$ in the output traveling wave, that can extend across length $L_x$ of the membrane-plate MP'. Following the suggestion to use approximately 8 current wires for every wavelength in the wave number, the example could have at least 16 wires. The example as shown in FIG. 6 depicts an embodiment with 28 current wires (M=28).

Define a desired response, so the surface-normal displacement of the membrane-plate $u_{y_d}(x,\omega)$ is a traveling wave in the x-direction, step 52, as represented in equations.

$$u_{y_d}(x,\omega) = Ce^{-jkx} \qquad \text{(equation 1)}$$

In equation 1, C denotes a scalar constant, j is the square root of (−1), A is a traveling wave wavelength, and k is a wave number of the traveling wave where $k=2\pi/\lambda$, as defined in step 51.

Express the desired normal displacement of the membrane-plate, $u_{y_d}(x,\omega)$, in terms of plate modes N in the solution, step 53. The function $\phi_n(x)$ is the mode shape of the $n^{th}$ output plate mode, having mode index n, where n=1 to N, and N goes to infinity. For a simply-supported plate, where a free-standing membrane-plate is supported by a base, $$\varphi_n(x) = \sin\left(\frac{n\pi}{L_x}x\right).$$

The normal displacement can be represented as a summation over n of Fourier coefficients $A_{n_d}$ of the desired output plate mode response, where desired amplitudes $A_{n_d}$ are the maximum displacements of a sine curve, as in equation 2.

$$u_{y_d}(x,\omega) = \sum_{n=1}^{N} A_{n_d}\sin\left(\frac{n\pi}{L_x}x\right) \qquad \text{(equation 2)}$$

In the example, the number of plate modes N equals 8. N preferably is chosen so that the summation converges and the omitted terms no longer contribute significantly to the summation.

Equate output plate mode response in equation 2, to traveling wave equation 1, to yield equation 3.

$$\sum_{n=1}^{N} A_{n_d} \sin\left(\frac{n\pi}{L_x}\right) = Ce^{-jkx} \quad \text{(equation 3)}$$

Using orthogonality of modes, a method known to those skilled in the art, multiply both sides of equation 3 by $$\sin\left(\frac{m\pi}{L_x}x\right),$$

and solve for the Fourier coefficients $A_{n_d}$ of the Lx desired plate mode response for traveling waves 54, as in equation 4 to get equation 5.

$$\sum_{n=1}^{N} A_{n_d} \int_0^{L_r} \sin\left(\frac{n\pi}{L_x}x\right)\sin\left(\frac{m\pi}{L_x}x\right)dx = \int_0^{L_r} Ce^{-jkx}\sin\left(\frac{m\pi}{L_x}x\right)dx \quad \text{(equation 4)}$$

$$A_{n_d} = C\frac{2n\pi}{(L_x)^2}1 - \frac{((-1)^{n+1}e^{jkL_r})}{\left(\frac{n\pi}{L_x}\right)^2 - k^2} \quad \text{(equation 5)}$$

Substitute equation 5 into equation 2, to find the desired displacement of the membrane-plate $u_{y_d}(x,\omega)$, in terms of output plate modes, resulting in equation 6.

$$u_{y_d}(x,\omega) = Ce^{-jkx} = C\sum_{n=1}^{N} \frac{2n\pi}{(L_x)^2}\frac{1-((-1)^{n+1}e^{jkL_x})}{\left(\frac{n\pi}{L_x}\right)^2 - k^2}\sin\left(\frac{n\pi}{L_x}x\right) \quad \text{(equation 6)}$$

Use an equation of motion, in two-dimensions, for a flat, simply-supported flexural plate wave device with internal plate tension $T_0$. This equation contains both flexural effects (term with D) and second-order membrane effects (term with $T_0$). The equation of motion is given by equation 7.

$$\frac{1}{\rho_p h}\left\{D\frac{\partial^4}{\partial x^4}u_{y_d}\left(x,\omega - T_0\frac{\partial^2}{\partial x^2}u_{y_d}(x,\omega)\right\} - \omega^2 u_{y_d}(x,\omega) = -\frac{1}{\rho_p h}\tau_{yy}(x,\omega) = -g(x,\omega) \quad \text{(equation 7)}$$

In equation 7, D is the flexural rigidity of the membrane-plate given by $D=Eh^3/(12(1-\nu^2))$, E is Young's modulus of plate material, h is the thickness of the plate, ν is Poisson's ratio of plate material, $\rho_p$ is the density of the plate, $T_0$ is the tension of the plate, $\omega=\pi\cdot f$ where f is the frequency of excitation of the current wires, $u_y(x,\omega)$ is the surface-normal displacement of the plate (the traveling wave output), and $r_{yy}(x,\omega)$ is a surface-normal stress loading input on the plate produced by a series of current (i) wires interacting with supplied magnetic field B on the membrane-plate (the input displacement). A permanent magnet can supply magnetic field B. A detailed analysis of the equations of motion for a flat, simply-supported plate in tension can be found in Dohner, "Aspects of the Micro-Scale Acoustics of a Fluid Loaded Flexural Plate Wave Sensor", Sandia Report SAND97-2772 UC-705, Dec. 22, 1997, incorporated herein by reference.

Use values available in the literature for silicon nitride (SiN), for the following properties: Young's modulus of plate material=E=0.27 N/$\mu$m$^2$, density of the plate material=$\rho_p=2.95\cdot10^{-5}$ kg·m/$\mu$m, Poisson's ratio of membrane-plate material=ν=0.24, tension in the plate=$T_0=0.7\cdot10^{-5}$ N/$\mu$m, and $\omega=\pi\cdot f$, where the frequency of excitation, $f=0.422\cdot10^6$ Hz.

Substitute the desired displacement, given in equation 6, into the equation of motion for a flat plate in tension in equation 7, to identify the forcing function g(x,ω)) required to produce the desired traveling wave displacement of the membrane-plate $u_{y_d}(x,\omega)$, step 55, given by equation 8.

$$g(x,\omega) = -C\sum_{n=1}^{N}\frac{2n\pi}{(L_x)^2}\frac{1-(-(-1)^n e^{jkL_r})}{\left(\frac{n\pi}{L_x}\right)^2 - k^2}\left\{\frac{1}{\rho_p h}\left\{D\left(\frac{n\pi}{L_x}\right)^4 + \left(T_0\left(\frac{n\pi}{L_x}\right)^2\right)\right\} - \omega^2\right\}\sin\left(\frac{n\pi}{L_x}x\right) \quad \text{(equation 8)}$$

Since the excitation occurs along spatially discrete current wires M, approximate the forcing function in equation 8 with a discrete function, step 56. An approximate forcing function $g_{ap}(x,\omega)$ required to produce the desired displacement of the plate $u_{yd}(x,\omega)$ over the discrete number of current wires is given in equation 9, where f(n,ω) is given in equation 10.

$$g_{up[}(x,\omega) \sim -C\sum_{l=1}^{M}\sum_{n=1}^{N} f(n,\omega)\sin\left(\frac{n\pi}{L_x}x\right)\delta(x-x(l))\Delta = \frac{iB}{\rho_p h}\sum_{l=1}^{M}\delta(x-x(l)) \quad \text{(equation 9)}$$

$$f(n,\omega) = \frac{2n\pi}{(L_x)^2}\frac{1-((-1)n^{n+1}e^{jkL_x})}{\left(\frac{n\pi}{L_x}\right)^2 - k^2}\left\{\frac{1}{\rho_p h}\left\{D\left(\frac{n\pi}{L_x}\right)^4 + \left(T_0\left(\frac{n\pi}{L_x}\right)^2\right)\right\} - \omega^2\right\} \quad \text{(equation 10)}$$

In equation 10, f(n,ω) is an amplitude coefficient for each of the plate modes indexed by n for n=1 to N, where N is finite, M is the number of wires, δ(x−x(l)) is a Dirac delta function, $$x(l) = l\Delta,\ l = 1 \text{ to } M, \text{ and } \Delta = \frac{L_x}{M+1}.$$

Equation 11 gives the current i into each wire l for l=1 to M, required to produce an approximation of the surface-normal stress on the membrane-plate for a traveling wave, as in step 57. Equation 11 is the result of equation 9 applied to every wire l, $$f(n,\omega) \text{ is defined as in equation 10, } x(l) = l\Delta,$$

$$l = 1 \text{ to } M, \text{ and } \Delta = \frac{L_x}{M+1}.$$

$$\frac{i(l,\omega)B}{\rho_p h} = -C\sum_{n=1}^{N} f(n,\omega)\sin\left(\frac{n\pi}{L_x}x(l)\right)\Delta \quad \text{(equation 11)}$$

The actual response of the membrane-plate is an approximation of the desired traveling wave, since the excitation occurs along spatially discrete current wires M and the forcing function was approximated with a discrete function. The Fourier coefficients for the actual response amplitude Am are obtained by substituting the current i needed to produce the surface-normal stress (given in equation 11) into the equation of motion for a flat, simply supported plate in tension (given by equation 7), and representing the surface-normal displacement of the plate in terms of plate modes (the actual response) by equation 12.

$$u_y(x,\omega)=\sum_{m=1}^{M} A_m \sin\left(\frac{m\pi}{L_x}x\right), \qquad \text{(equation 12)}$$

where $m$ goes to infinity.

Solving for the actual membrane-plate response yields equation 13 for the Fourier coefficients.

$$A_m = C\sum_{n=1}^{N}\frac{4n\pi}{(L_x)^3}\,\frac{1-((-1)^{n+1}e^{jkL_x})}{\left(\frac{n\pi}{L_x}\right)^2-l^2}\,\frac{\left\{\frac{1}{\rho_p h}\left\{D\left(\frac{n\pi}{L_x}\right)^4+\left(T_0\left(\frac{n\pi}{L_x}\right)^2\right)\right\}-\omega^2\right\}}{\left\{\frac{1}{\rho_p h}\left\{D\left(\frac{m\pi}{L_x}\right)^4+\left(T\left(\frac{m\pi}{L_x}\right)^2\right)\right\}-\omega^2\right\}}\sum_{l=1}^{M}\sin\left(\frac{n\pi}{L_x}x(l)\right)\sin\left(\frac{m\pi}{L_x}x(l)\right)\Delta \qquad \text{(eqn 13)}$$

In equation 13, m is a plate mode index, and $A_m$ are the amplitudes of the Fourier coefficients for the actual response.

A practitioner can obtain more control over the membrane-plate as the number of current wires M increases, and the approximated solution approaches the desired solution. Note that as M approaches infinity, then $A_m$ (the Fourier coefficients of the approximated response at finite points on the current wires) approaches $A_{n_d}$ (the Fourier coefficients of the desired plate mode response for a traveling wave). There are physical plate construction limits that prevent driving the number of wires M to infinity. For example, if two wavelengths λ can extend across length $L_x$ of the membrane-plate, then approximately 16 membrane-plate current wires can be used. To move to shorter (and consequently more) wavelengths λ across length $L_x$, then more wires can be used to control the membrane-plate. The maximum number of wires that can be mounted with the membrane-plate is bounded by fabrication limits and physical membrane-plate and wire dimensions.

Current Excitation and Plate Response for Example Implementation

Figure 7:
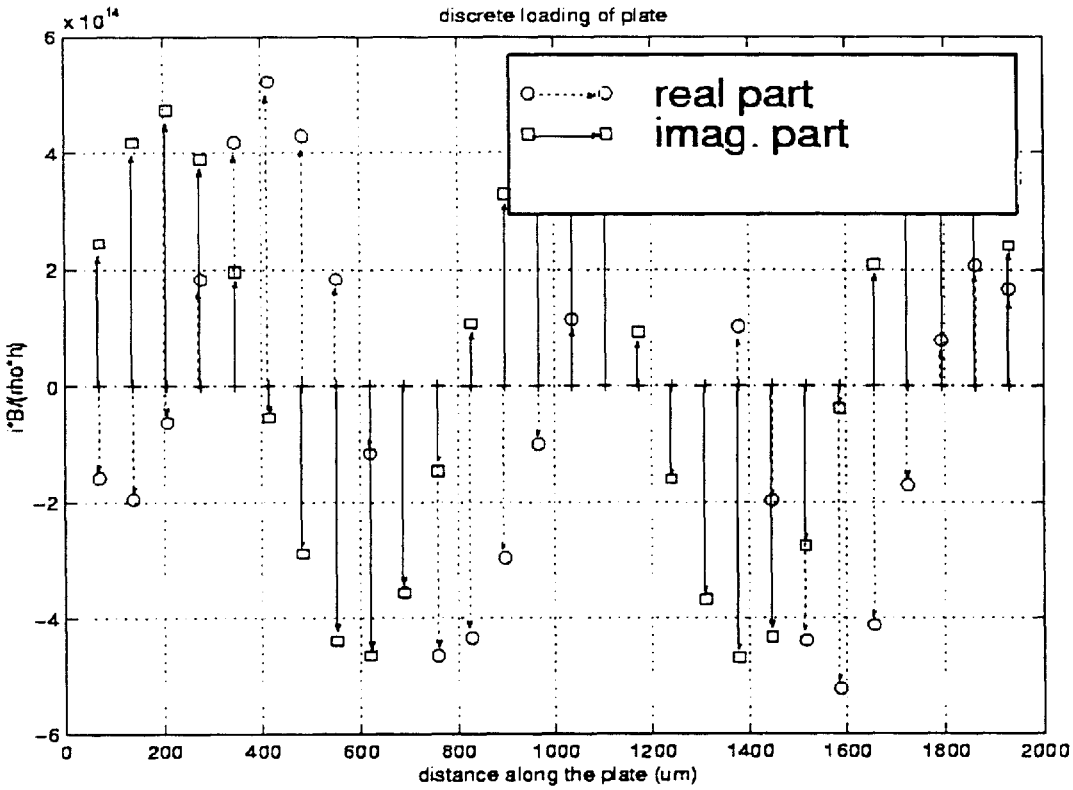
FIG. 7 is a graph of real and imaginary parts of current excitation at each current wire in a flexural plate wave device according to the present invention.

FIG. 7 is a graph showing the real and imaginary parts of the current excitation at each current wire, for the example with 28 current wires.

Figure 8:
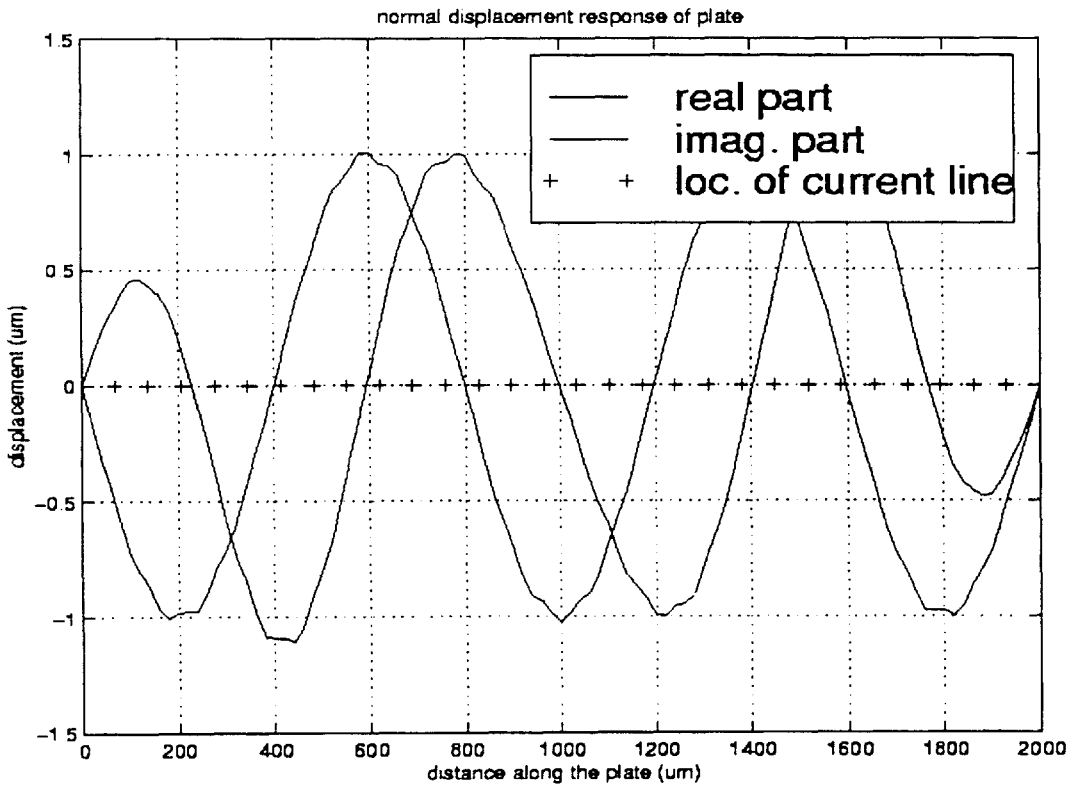
FIG. 8 is a graph of the response of a plate according to the present invention due to the excitation in FIG. 7.

FIG. 8 is a graph showing the response of the plate due to the FIG. 7 excitation. The normal displacement response of the membrane-plate is given in FIG. 8, as a result of the FIG. 7 excitation/loading. The response is similar to the desired response (given in step 53 of the active control process steps), except at the plate boundaries at 0 μm and 2000 μm (the end locations of the plate), where a traveling wave solution cannot exist because of the clamped boundary condition.

The membrane-plate response at each of the 28 current lines has an imaginary component and a real component, and forms an output real wave and an output imaginary wave which are approximately identical in shape, and are phase shifted by approximately 90 degrees.

Micro-Scale Fluid Pumps

When the traveling waves in a flexural plate wave device are coupled to a fluid, acoustic streaming in the fluid can be produced, and can produce a pump. Acoustic streaming in a fluid results from the production of a steady force by an acoustic field. Acoustic streaming is a second order effect which will produce a mean motion in a viscous, acoustic fluid. Examples of acoustic fluids include gases, light liquids, and heavy liquids. For the purposes of the previous 28 wire example, the fluid represented is a light fluid.

Figure 9A:
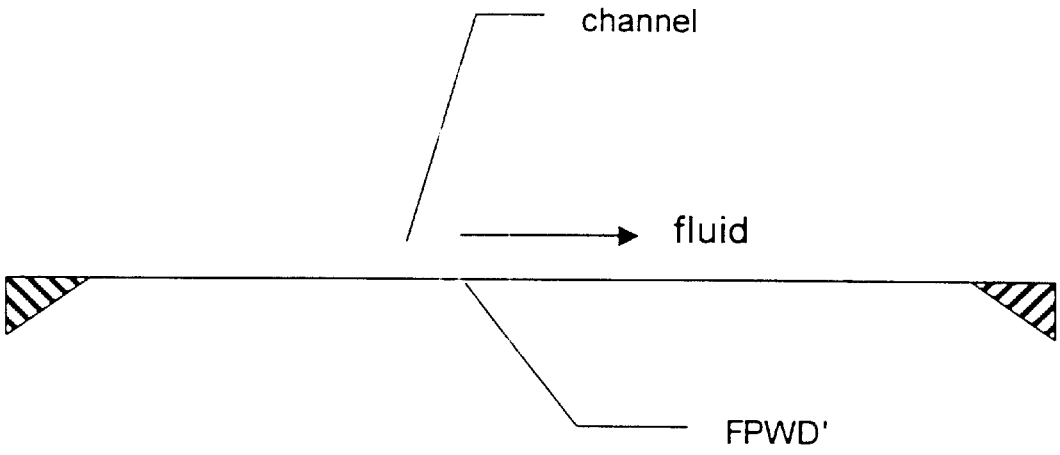
FIGS. 9(*a,b*) is a set of sectional-views of micro-scale fluid pumps according to the present invention.
Figure 9B:
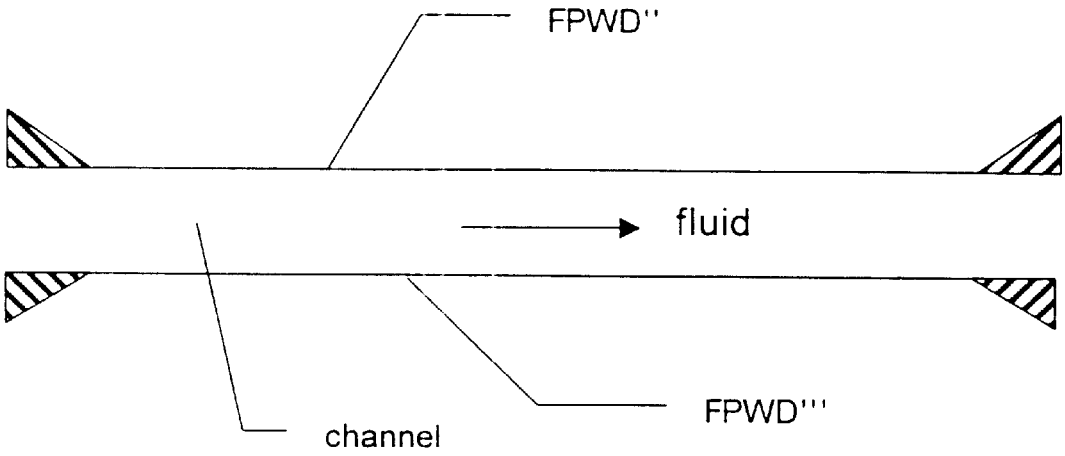

FIGS. 9*a* and 9*b* are each diagrams of a micro-scale fluid pump according to the present invention. Two example pumps are shown. The example micro-scale fluid pump shown in FIG. 9*a* has one flexural plate wave device FPWD' mounted with a channel. Traveling waves in flexural plate wave device FPWD' can be coupled to a fluid, where the fluid flows across the flexural plate wave device FPWD'. Although a channel will contain the fluid, the channel does not need to be an enclosed channel.

The micro-scale fluid pump shown in FIG. 9*b* depicts two flexural plate wave devices FPWD" and FPWD'" mounted with a channel where the devices are in opposition. Flexural plate wave devices FPWD" and FPWD'" can be actively controlled to work together to pump fluid across the devices FPWD" and FPWD'".

Figure 10:
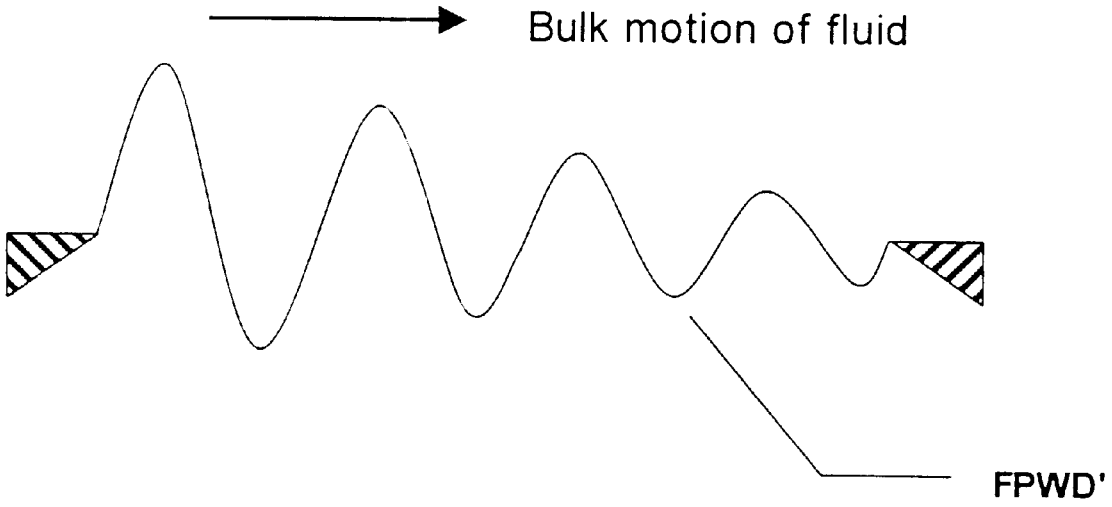
FIG. 10 is a sectional view showing the movement of fluid in a micro-scale fluid pump according to the present invention.

FIG. 10 is a sectional view showing the movement of fluid in a micro-scale fluid pump in example flexural plate wave device FPWD' placed in a channel. FIG. 10 shows a decaying output traveling wave in membrane-plate MP' and the coupled fluid moving across membrane-plate MP' length $L_x$'. The wave shown is in flexural plate wave device FPWD' and corresponds to a membrane-plate displacement in a surface-normal direction. The motion corresponds to an attenuated traveling wave, which has been coupled to a fluid in communication with flexural plate wave device FPWD', and used to impart directional flow to move the fluid.

The particular sizes and equipment discussed above are cited merely to illustrate particular embodiments of the invention. It is contemplated that the use of the invention may involve components having different sizes and characteristics. It is intended that the scope of the invention be defined by the claims appended hereto.

I claim:

1. A method for actively controlling a micro-scale flexural plate wave device to generate traveling waves therein, wherein said flexural plate wave device has a membrane-plate with a length, a width, an upper surface, a supporting base, and a plurality of membrane-plate surface wires mounted with said upper surface, where said plurality of wires runs substantially the width of said upper surface, and wherein the method comprises:

a) generating a current, having a current amplitude and a current phase, through each of said wires;

b) applying a magnetic field substantially perpendicular to said currents; and c) coordinating said current through each of said wires and said magnetic field to force traveling waves in said device.

2. The method of claim 1, wherein said traveling waves comprise substantially non-reflecting, traveling waves.

3. The method of claim 1, wherein said traveling waves comprise continuously generated traveling waves.

4. The method of claim 1, wherein said membrane-plate has length $L_x$, wherein said traveling waves have a direction of travel in an x-direction along said length $L_x$, wherein said current and said magnetic field are coordinated by:

a) selecting a traveling wave wavelength, denoted λ, to generate in said membrane-plate;

b) forcing a flexural plate wave device response, having a surface-normal membrane-plate displacement, denoted $u_{y_d}$ having response attributes, wherein:

i) k denotes a wave number for said wavelength;

ii) ω denotes a membrane-plate frequency in radians per second;

iii) N is an integer number of output plate modes to be used in the solution, where N is greater than zero;

iv) n is a plate mode index, having integer values from 1 to N;

v) $A_{n_d}$ denotes Fourier coefficients of said output plate modes;

vi) $\phi_n(x)$ denotes a mode shape of the $n^{th}$ output plate mode;

vii) C denotes a scalar constant; and viii) j denotes a square root of (−1);

and said response attributes relate said membrane-plate displacement to said traveling waves by:

$$u_{y_d}(x, \omega) = \sum_{n=1}^{N} A_{n_d}\varphi_n(x) = Ce^{-jkx},$$

5. The method of claim 4, wherein for every plate mode index n, said mode shape is given by:

$$\varphi_n(x) = \sin\left(\frac{n\pi}{L_x}\right).$$

6. The method of claim 1, wherein said membrane-plate has length $L_x$, thickness h, material density $\rho_p$, flexural rigidity denoted D, initial tension denoted $T_0$, membrane-plate frequency in radians per second denoted ω, and wires denoted l, where l is a wire index beginning at a first end of said length and extending to a second end of said length, where said index has integer values from one to a total number of said wires, where generating a current through each of said wires comprises inputting currents, denoted i(l,ω), into each of said wires, wherein:

a) N is an integer number of output plate modes to be used in the solution, where N is greater than zero;

b) n is a plate mode index, having integer values from 1 to N;

c) C denotes a scalar constant;

d) λ denotes a traveling wave wavelength;

e) k denotes a wave number for said wavelength;

f) B denotes a field strength for a magnetic field;

g) j denotes a square root of (−1);

h) f(n,ω) is a Fourier coefficient;

i) Δ denotes the separation spacing between said wires;

j) x(l) is an incremental membrane-plate length x(l), where each x(l) is an increment of Δ larger than the previous x(l); and k) $\phi_n(x(l))$ denotes a mode shape of the $n^{th}$ output plate mode;

and for every wire 1, said i(l,ω) is given by:

$$\frac{i(l, \omega)B}{\rho_p h} = -C\sum_{n=1}^{N} f(n, \omega)\varphi_n(x(l))\Delta.$$

7. The method of claim 6, wherein for every plate mode index n, said mode shape is given by:

$$\varphi_n(x(l)) = \sin\left(\frac{n\pi}{L_x}x(l)\right).$$

8. The method of claim 7, wherein the total number of wires is sufficient to provide greater than one wire per each of said traveling wave wavelengths.

9. The method of claim 7, wherein the total number of wires is sufficient to provide greater than 8 wires per each of said traveling wave wavelengths.

10. The method of claim 1, wherein said magnetic field has a substantially constant field strength.

11. A method for actively controlling a micro-scale fluid pump comprising a flexural plate wave device to generate traveling waves therein, wherein said flexural plate wave device comprises a membrane-plate with an upper surface and a plurality of wires mounted with said upper surface, wherein said flexural plate wave device is mounted in a fluid channel, having fluid in said channel, said method comprising:

a) generating a current, having a current amplitude and a current phase, through each of said wires;

b) applying a magnetic field substantially perpendicular to said currents;

c) coordinating said current through each of said wires and said magnetic field to force traveling waves in said device; and d) coupling said traveling waves to said fluid.

12. The method of claim 11, wherein said traveling waves travel substantially perpendicular to said wires.

13. The method of claim 11, wherein said traveling waves comprise continuously generated, substantially non-reflecting, traveling waves.

14. A micro-scale fluid pump comprising:

a) a fluid channel;

b) a flexural plate wave device mounted with said channel, said flexural plate wave device comprising:

I) a base;

ii) a membrane-plate with a width and an upper surface, mounted with said base; and iii) a plurality of wires mounted with said upper surface, running substantially the width of said upper surface; and c) an active controller connected to said wires, comprising:

I) a magnetic field generator, for generating a magnetic field substantially perpendicular to said wires; and ii) a plurality of current sources, electrically connected to said wires, and means for coordinating with said magnetic field generator and with said current sources to produce traveling waves in said flexural plate wave device.

15. The micro-scale fluid pump of claim 14, wherein said membrane-plate has length $L_x$ and membrane-plate frequency in radians per second w, wherein said traveling waves have a direction of travel in an x-direction, wherein said magnetic field generator and said plurality of current sources are coordinated according to:

a) a traveling wave wavelength, denoted λ, to generate in said membrane-plate;

b) a flexural plate wave device response, having a surface-normal membrane-plate displacement, denoted $u_{y_d}$ having response attributes, wherein:

i) N is an integer number of output plate modes to be used in the solution, where N is greater than zero;

ii) n is a plate mode index, having integer values from 1 to N;

iii) C denotes a scalar constant;

iv) k denotes a wave number for said traveling wave wavelength;

v) j denotes a square root of (−1);

vi) $\phi_n(x)$ denotes a mode shape of the $n^{th}$ output plate mode; and vii) $A_{n_d}$ denotes Fourier coefficients of said output plate modes;

and said response attributes relate said membrane-plate displacement to said traveling waves by:

$$u_{y_d}(x, \omega) = \sum_{n=1}^{N} A_{n_d}\varphi_n(x) = Ce^{-jkx}.$$

16. The micro-scale fluid pump of claim 15, wherein for every plate mode index n, said mode shape is given by:

$$\varphi_n(x) = \sin\left(\frac{n\pi}{L_x}\right).$$

17. The micro-scale fluid pump of claim 14, wherein said membrane-plate has length $L_x$, thickness h, material density $\rho_p$, flexural rigidity denoted D, initial tension denoted $T_0$, membrane-plate frequency in radians per second denoted ω, and wires denoted l, where l is a wire index beginning at a first end of said length and extending to a second end of said length, where said index has integer values from one to a total number of said wires, wherein said plurality of current sources generate currents, denoted i(l,ω), input into each of said wires, according to:

a) N is an integer number of output plate modes to be used in the solution, where N is greater than zero;

b) n is a plate mode index, having integer values from 1 to N;

c) C denotes a scalar constant;

d) λ denotes a traveling wave wavelength;

e) k denotes a wave number for said wavelength;

f) B denotes a field strength for a magnetic field;

g) j denotes a square root of (−1);

h) f(n,ω) is a Fourier coefficient;

i) Δ denotes the separation spacing between said wires;

j) x(l) is an incremental membrane-plate length x(l), where each x(l) is an increment of Δ larger than the previous x(l); and k) $\phi_n(x(l))$ denotes a mode shape of the $n^{th}$ output plate mode;

and for every wire l, said i(l,ω) is given by:

$$\frac{i(l, \omega)B}{\rho_p h} = -C\sum_{n=1}^{N} f(n, \omega)\varphi_n(x(l))\Delta.$$

18. The micro-scale fluid pump of claim 17, wherein said magnetic field has a substantially constant field strength.

19. The micro-scale fluid pump of claim 17, for every plate mode index n, said mode shape is given by:

$$\varphi_n(x(l)) = \sin\left(\frac{n\pi}{L_x}x(l)\right).$$

* * * * *